US005454877A

United States Patent [19]

Worsham

[11] Patent Number: 5,454,877

[45] Date of Patent: Oct. 3, 1995

[54] METHOD FOR CLEANING SPHERICAL OBJECTS AND THE LIKE

[75] Inventor: Jack W. Worsham, Greensboro, N.C.

[73] Assignee: Intertech Corporation, Greensboro, N.C.

[21] Appl. No.: 304,165

[22] Filed: Sep. 12, 1994

Related U.S. Application Data

[62] Division of Ser. No. 148,967, Nov. 8, 1993, Pat. No. 5,373,597.

[51] Int. Cl.[6] ..... B08B 1/04

[52] U.S. Cl. ..... 134/6; 134/25.3; 134/25.4; 134/32

[58] Field of Search ..... 134/6, 25.3, 25.4, 134/32; 15/21.2

[56] References Cited

U.S. PATENT DOCUMENTS

| | | | |
|---|---|---|---|
| 3,120,669 | 2/1964 | Montuori | 15/97.1 |
| 3,820,183 | 6/1974 | Gustafson et al. | 15/21.2 |
| 4,773,114 | 9/1988 | Thrasher | 15/21.2 |
| 4,805,251 | 2/1989 | Hollrock | 15/21.2 |
| 4,881,287 | 11/1989 | Knez | 15/21.2 |
| 4,970,746 | 11/1990 | Brackmann | 15/21.2 |

FOREIGN PATENT DOCUMENTS 669379 4/1950 United Kingdom .

*Primary Examiner*—Peter Chin
*Assistant Examiner*—Sean Vincent

[57] ABSTRACT

A method is provided for washing spherical objects such as toy balls and the like. The balls are delivered into a bin above a hopper where they are manipulated to prevent jamming as they are passed from the hopper to a channel below consisting of rotating and stationary brushes. The balls are brushed and a detergent solution is applied. The balls are then rinsed and air is forced over them to dry any moisture thereon. The balls then exit through a discharge where they can then be collected and reused.

10 Claims, 2 Drawing Sheets

METHOD FOR CLEANING SPHERICAL OBJECTS AND THE LIKE

This is a divisional of application Ser. No. 08/148,967 filed 08 Nov. 1993, now U.S. Pat. No. 5,373,597.

BACKGROUND OF THE INVENTION

1. Field of the Invention

The invention herein pertains to a device for washing spherical objects such as toy balls and pertains particularly to a process and apparatus for lightweight balls as are used in children's "dry" pools.

2. Description of the Prior Art and Objectives of the Invention

In recent years playgrounds for children, arcades and other locations have installed "dry" pools for children whereby a pit is formed and is filled with relatively soft, light, resilient polymeric balls which may be for example approximately 76 to 82 mm. in diameter. Children then jump, romp and play in the ball pools as they would do in a conventional wading pools, but without getting wet. After a relatively short period of use, the balls become soiled if they are not regularly cleaned, and an unsanitary environment develops which is unattractive to the owners and parents of the children. Thus, it has been the practice to the current time to remove the balls and place them in an open net bag where they are washed in a tub or the like. Conventional ball cleaning processes have not been totally effective since the balls are relatively large in size yet light in weight and tend to be difficult to handle during cleaning. Current methods of washing have been less than satisfactory and owners often delay in cleaning the balls, causing them to become even more soiled, unattractive and unsanitary.

Due to the disadvantages, inconvenience and problems associated with conventional washing techniques, the present invention was conceived and one of its objectives is to provide apparatus and a method for cleaning spherical objects such as "dry" pool balls as are used in children's playgrounds in a quick, efficient manner.

It is yet another objective of the present invention to provide a method for cleaning such spherical objects which is both convenient and economical.

It is still another objective of the present invention to provide a device and method for cleaning spherical objects which includes a cleaning channel formed by stationary and revolving brushes through which the objects pass during the cleaning process.

It is also an objective of the present invention to provide a hopper for feeding objects into the cleaning channel which includes a means to manipulate the objects within the hopper to prevent jamming.

It is also another objective of the present invention to provide a cleaning apparatus for spherical objects and the like which includes apparatus for spraying a chemical cleaner onto the balls as they enter the cleaning channel and a rinse outlet proximate the channel exit.

It is still another objective of the present invention to provide an apparatus for cleaning spherical objects which includes a fan for drying the objects after they are rinsed.

Various other objectives and advantages of the present invention will become apparent to those skilled in the art as a more detailed presentation is set forth below.

SUMMARY OF THE INVENTION

The aforesaid and other objectives are realized by providing apparatus and a method for cleaning spherical objects and the like which consists of a housing having a bin on top for depositing soiled balls or the like therein. A hopper is positioned below the bin within the housing which contains an agitator to allow the balls to move smoothly through the hopper into a ball chute therebelow. One or more chutes may be provided for directing the balls into one or more cleaning channels. The cleaning channels are defined by a stationary circular vertical brush and an opposing rotating circular vertical brush along each side of the channel. The interior of the channel provides a central support comprising a rotating brush and positioned above the central support is a top brush with a channel guide rail on each side. The balls move through the channel where they are contacted by the brushes and a cleaning solution or sanitizer is sprayed therein. A water rinse and air drying is also available prior to exiting the housing.

The method of cleaning involves manipulating the balls within the hopper with the agitator to prevent the balls from jamming and thereafter passing the balls into the cleaning channel where they are cleaned by the stationary and rotating brushes for delivery through a discharge for collection and reuse.

DESCRIPTION OF THE PREFERRED EMBODIMENT

The preferred embodiment of the invention is shown in FIGS. 1–5 for cleaning spherical objects such as balls or the like. The device includes a rectangular shaped metal housing having a ball bin with transparent sides mounted atop the housing. Below the bin, within the housing is a ball hopper having two ball chutes extending downwardly therefrom. A 58 rpm electric motor powers a drive shaft on a hopper agitator having a series of fingers positioned in the hopper to accommodate each ball chute to prevent the balls from jamming. The method allows the balls to pass below the hopper into a cleaning channel which is defined by a fixed upper guide rail, a rotating central support, one rotating circular side brush and one stationary side brush. The preferred form of the apparatus utilizes a circumferential circular brush as the central support and employs a top brush with a pair of fixed guide rails. The motor which drives the hopper agitator is linked by a chain to the brush shaft for turning the rotating brushes and central supports. The preferred form of the invention also includes two cleaning chambers for accommodating up to 12,000 balls per hour. A cleaning solution reservoir is in fluid communication with a pulse pump which directs a stream of cleaning solution into the cleaning chamber. A water inlet is also provided proximate the exit of the cleaning chamber to rinse the balls passing therethrough. A fan in the lower housing directs air into a ball discharge for drying, prior to the balls existing the housing. Once the balls pass through the discharge they are collected in a clean, dry state to be reused in the pools.

The two outside brushes of the two cleaning chambers and guide rails are fixed whereas the central supports and opposing inside brushes rotate. A drive chain is attached to the brush shaft and motor which turns the brush shaft at 58 rpms as it connected to the motor shaft.

DETAILED DESCRIPTION OF THE DRAWINGS AND OPERATION OF THE INVENTION

Figure 3:
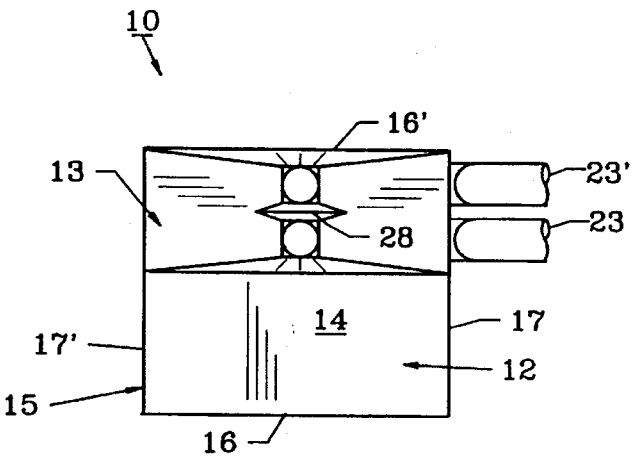
FIG. 3 demonstrates a top plan view of the apparatus as shown in FIG. 1 without the hopper agitator in place.
Figure 2:
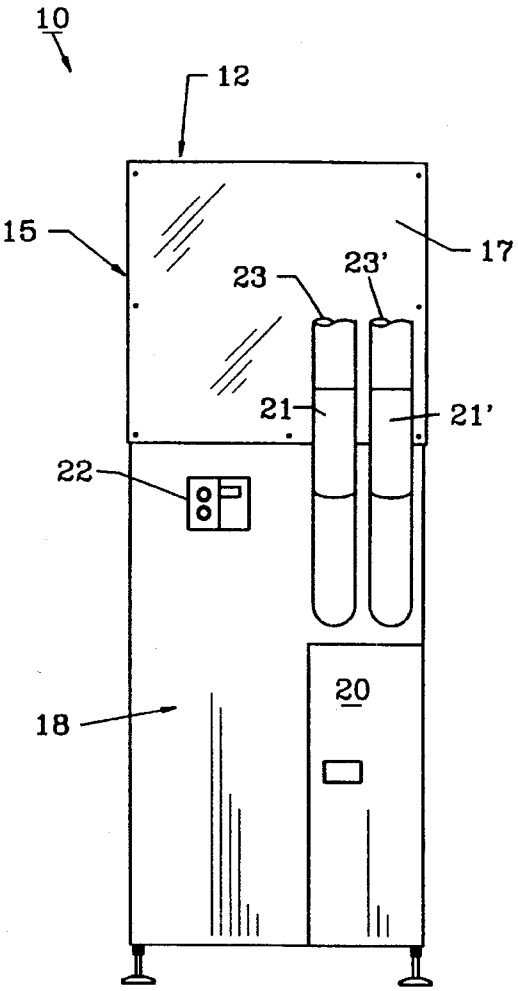
FIG. 2 illusrates a right side elevational view thereof.
Figure 1:
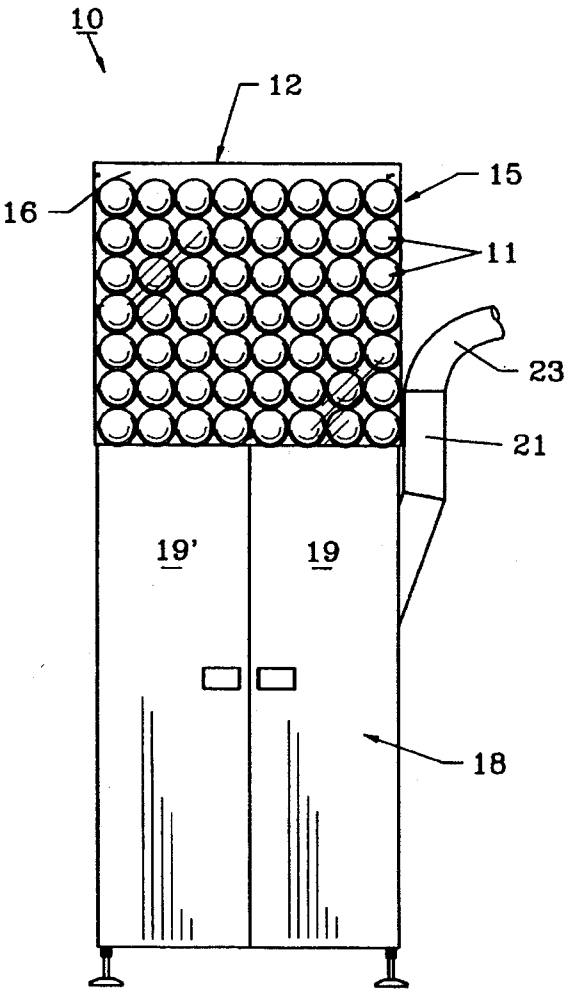
FIG. 1 demonstrates a front elevational view of the cleaning apparatus for spherical objects.

For a more complete understanding of the invention and its method of operation, turning now to the drawings, FIG. 1 illustrates apparatus 10 for cleaning spherical objects and the like such as lightweight resilient "dry" pool balls as are used at children's playgrounds. Balls 11 may be any of a variety of sizes but generally range from 76 to 82 millimeters in diameter. Such pools are positioned on the ground or floor for children to jump in, romp and play. Balls 11 are very lightweight and resilient whereby small children can use the pools without fear of injury. As many playgrounds are built adjacent to restaurants, food and beverages are often spilled and accidents which children often have, require balls 11 to be removed and cleaned on a regular basis for appearance, sanitation and health reasons. Apparatus 10 which has an open top 12 of bin 15 as seen in FIG. 3 allows balls 11 to be gathered from a dry pool, placed in a bag, container or the like and conveniently dumped into bin 15. Vacuum or blowing pressure as supplied through a hose may alternatively be used to convey or deliver continuously a quantity of balls to bin 15 for cleaning. As seen in FIG. 3, hopper 13 is shown below bin 15 whereby biased bottom surface 14 directs balls into hopper 13, as further illustrated in FIG. 5. Ball bin 15 includes front wall 16, rear wall 16', right side wall 17 and left side wall 17', all formed from a transparent material such as an acrylic polymer whereby balls 11 placed in bin 15 can be easily seen and bin 15 refilled as necessary. Housing 18 below bin 15 comprises a stainless steel cabinet having front doors 19, 19' and rear access door 20 as shown in FIG. 2. Also in FIG. 2 ball discharge 21, 21' are seen along with electrical power switch 22. Suitable discharge hoses 23, 23' (not fully shown) or other conduits and/or containers can be affixed to ball discharges 21, 21' to collect cleaned balls as they exit apparatus 10 through discharges 21, 21.

Figure 5:
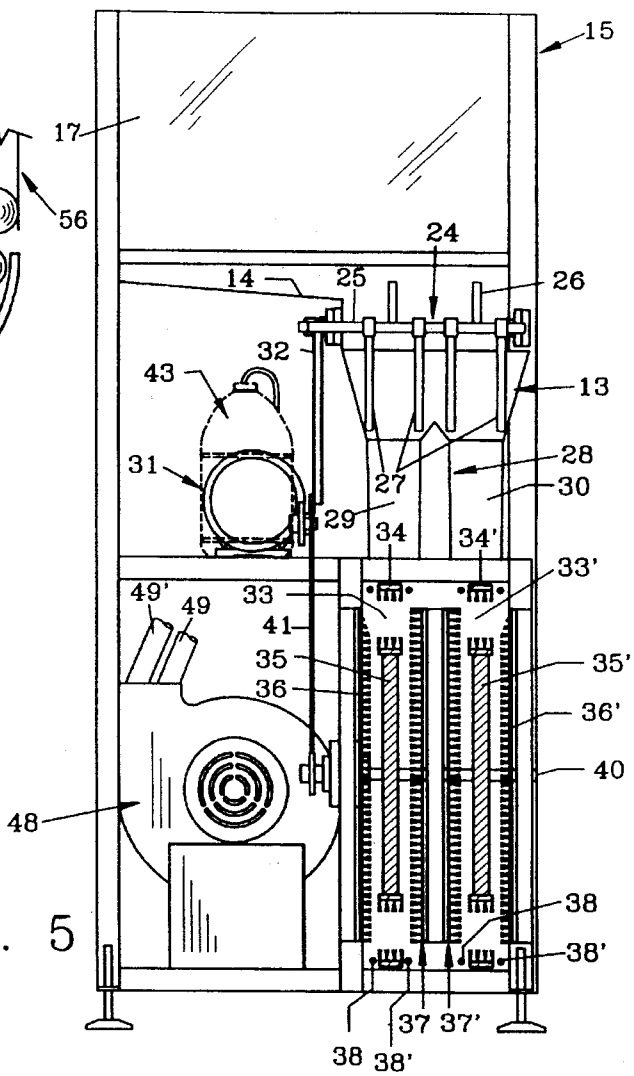
FIG. 5 shows an enlarged right side view of the apparatus with the walls, return chutes and access door removed.
Figure 4:
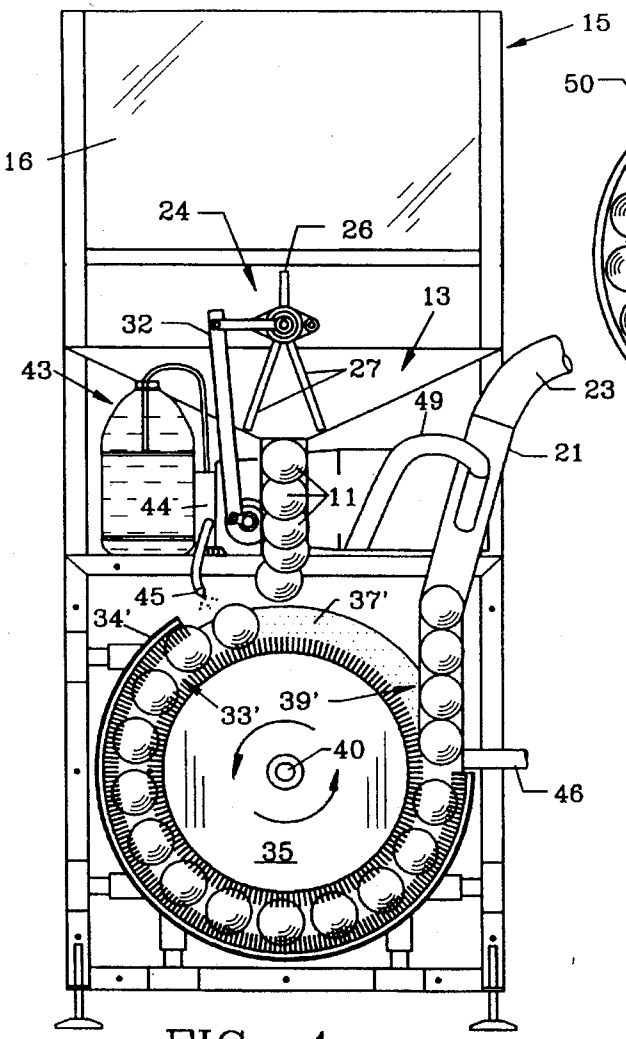
FIG. 4 demonstrates an enlarged front view of the cleaning apparatus with the front doors removed.

Once balls 11 are placed within bin 15, they pass by gravity along biased bottom surface 14 as seen in FIG. 5 into hopper 13. Hopper agitator 24 provides a means to manipulate balls 11 therewithin to prevent them from jamming and to insure a smooth flow through. Hopper agitator 24 includes a drive shaft 25 to which upright fingers 26 are attached along with downwardly depending fingers 27. Hopper 13 as seen is divided into two compartments as shown in FIG. 3 by wall divider 28. In FIG. 5, two downwardly depending fingers 27 and one upright finger 26 are shown on each side of hopper wall divider 28. Thus, adequate agitation is provided to allow balls 11 as they pass into ball chutes 29 and 30 directly below hopper 13. Fingers 27 are positioned approximately twenty degrees (20°) from the vertical center line of drive shaft 25, in alternating fashion as shown in FIG. 4. Upright finger 26 is positioned along the vertical center line as also shown in FIG. 4. Drive shaft 25 is bearingly mounted within hopper 13 and is powered by motor 31 which may be a one-half (0.5) horsepower, 110 volt AC, fifty-eight (58) rpm motor. Linkage 32 transfers power from motor 31 to drive shaft 25 as is conventional in the art. Balls 11 are lightweight, hollow, resilient and tend to easily jam or clog in hopper 13 due to their light weight and resiliency. Heavy spherical objects such as baseballs, golf balls, oranges or the like have a greater density and do not tend to as readily jam. However, agitator 24 relieves the problem of jamming and maintains a steady flow of balls 11 from hopper 13 into ball chutes 29 and 30. Once balls 11 pass through chutes 29, 30 they are delivered into cleaning channels 33, 33' therebelow. Chambers 33, 33' are arcuate as shown in FIG. 4 and are formed respectively by stationary top brushes 34, 34', arcuate guide rails 38, 38', (not shown) rotating central supports 35, 35' stationary side brushes 36, 36' and rotating side brushes 37, 37'. As shown in FIG. 5 stationary side brushes 36, 36' have a bias cut along the upper portion to facilitate ball entry into cleaning cannels 33, 33'. Guide rails 38, 38' are shown in FIG. 5. All brush surfaces are formed from nylon bristles appoximately one (1) inch in length having a diameter of 0.012 inches. Nylon brushes have been selected for their economy and durability although other types of brushes and/or surfaces could be substituted, depending on the particular object to be cleaned or for other reasons.

As further shown in FIG. 4, balls 11 enter channel 33' and due to the counterclockwise rotational motion of central support 35' and side brush 37', balls 11 are directed through channel 33' where they subsequently exit along baffle plate 39' which serves as a guide to direct the balls outwardly through ball discharge 21. As would be understood, apparatus 10 as shown in FIGS. 1–5 includes two (2) cleaning channels 33, 33'. However, more or less cleaning channels could be made available to customers depending on their particular cleaning requirements. It has been found that apparatus 10 will process approximately twelve thousand (12,000) balls per hour (6,000 balls per channel) and this capacity is sufficient for most average dry pool installations. However, for larger installations, 36,000 to 48,000 balls per hour capacity can be made available by use of a larger hopper and with additional cleaning channels.

As hereinbefore mentioned, channel 33 is formed by somewhat circular stationary top brush 34, guide rails 38, 38', rotating disk-like central support 35, stationary disk-like side brush 36 and rotating disk-like side brush 37 which are positioned to form channel 33 with inner dimensions slightly smaller than the diameter of ball 11 to insure adequate contact therewith to clean ball 11 as it passes therethrough.

To provide power to the rotating brushes (FIG. 5), brush drive shaft 40 is rigidly affixed to rotating central supports 35, 35' and to rotating side brushes 37, 37'. Brush drive shaft 40 is driven by drive chain 41 which is conventionally connected to motor 31 in direct fashion whereby brush drive shaft 40 turns at fifty-eight (58) rpms as does motor 31.

To insure proper cleaning of balls 11, a liquid detergent or sanitizing solution is contained within reservoir 43 which is connected to a standard electric pulse pump 44 to dispense liquid through spray head 45. Spray head 45 delivers a mist of cleaning solution onto balls 11 as they enter channel 33' as shown in FIG. 4. A similar arrangement is provided for balls 11 entering cleaning channel 33. Balls 11 which pass through channel 33' are rinsed by fresh water passing through rinse inlet 46 which is connected to a suitable supply (not shown). Once the rinse water has been applied to balls 11 they are then dried by forced air from fan 48 as shown in FIG. 5 which urges air through conduits 49, 49' respectively and into ball discharges 21, 21' as seen in FIG. 2. Balls which pass through ball discharges 21, 21' are delivered through discharge hoses 23, 23' as seen in FIG. 2 to a collection container or otherwise as desired.

Figure 6:
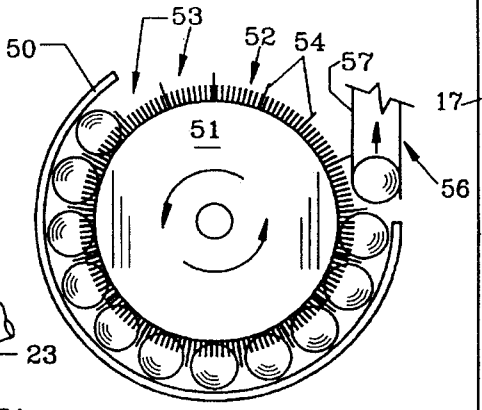
FIG. 6 shows another embodiment of a central support and fixed guide rail as removed from the housing.

In another embodiment of a cleaning channel as schematically shown in FIG. 6, fixed channel guide rail 50 comprises a steel rail without a brush surface. Also rotating central support 51 includes a brush surface 52 which is separated into compartments 53 by radial members 54 which extend from central support 51 beyond brush surface 52. Central support 51 and channel guide 50 can be used when heavy or dense objects are to be cleaned. Ball discharge diverter 56 is also seen in FIG. 6 which has fork-like member 57 to straddle radial members 54 which pass thereunder and divert balls into discharges as hereinbefore explained.

The illustrations and examples provided herein are for explanatory purposes and are not intended to limit the scope of the appended claims.

I claim:

1. The method of cleaning objects comprising the steps of:

(a) placing the object to be cleaned in a hopper device;

(b) passing the object from the hopper device to a circular channel formed by a fixed circular brush and a rotating circumferential brush;

(c) moving the object through the circular channel; and (d) rotating the circumferential brush to clean the object as it moves through the circular channel.

2. The method of claim 1 and including the step of manipulating the objects within the hopper device.

3. The method of claim 1 and including the step of spraying the object in the circular channel with a liquid.

4. The method of claim 1 and including the step of rinsing the object in the circular channel with a liquid.

5. The method of claim 1 and including the step of delivering the cleaned object to a collection container.

6. The method of cleaning an object comprising the steps of:

(a) placing an object to be cleaned in a hopper device;

(b) passing the object from the hopper device to a vertical circular channel formed by a rotating circumferential brush and a fixed circular brush;

(c) moving the object through the vertical circular channel while cleaning the object; and (d) delivering the cleaned object for collection.

7. The method of claim 6 and including the step of applying a liquid to the object as it passes through the vertical circular channel.

8. The method of claim 6 and including the step of rinsing the object as it passes through the vertical circular channel.

9. The method of claim 6 and including the step of manipulating the object while it is in the hopper device.

10. The method of claim 9 wherein the step of manipulating the object comprises moving the object with a mechanical finger.

* * * * *